US005645220A

United States Patent [19]

Höhndorf

[11] Patent Number: 5,645,220

[45] Date of Patent: Jul. 8, 1997

[54] AIR NOZZLE WITH VARIABLE SPRAY PATTERN

[75] Inventor: Wolfgang Höhndorf, Tuttlingen, Germany

[73] Assignee: Chiron-Werke GmbH & Co. KG, Germany

[21] Appl. No.: 427,282

[22] Filed: Apr. 21, 1995

[30] Foreign Application Priority Data

Dec. 20, 1994 [DE] Germany ..... 9420324 U

[51] Int. Cl.[6] ..... B05B 1/26

[52] U.S. Cl. ..... 239/301; 239/543

[58] Field of Search ..... 239/290, 292, 239/293, 590, 590.3, 300, 301, 543

[56] References Cited

U.S. PATENT DOCUMENTS

| | | | |
|---|---|---|---|
| 2,102,303 | 12/1937 | Bramsen et al. | 239/292 X |
| 2,138,300 | 11/1938 | Gustafsson | 239/290 X |
| 2,261,279 | 11/1941 | Pellar | 239/290 |
| 2,888,207 | 5/1959 | Sykes | 239/301 |
| 4,531,675 | 7/1985 | Muck | 239/301 X |
| 4,618,098 | 10/1986 | Hedger et al. | 239/290 |

FOREIGN PATENT DOCUMENTS

| | | | |
|---|---|---|---|
| 724706 | 7/1942 | Germany | 239/292 |
| 1118464 | 7/1968 | United Kingdom | 239/290 |

*Primary Examiner*—Kevin Weldon
*Attorney, Agent, or Firm*—Pretty, Schroeder & Poplawski

[57] ABSTRACT

An air head (10), in particular for a spray gun, for ejecting a jet of spray medium. The air head (10) comprises a flow bush (19) and a rotationally fitted air distributor whose end wall (37) has a central flow hole (25) which is opposed by a second flow hole (26) in an end wall (42) of the flow bush (19) facing the air distributor (18) in such a way that the spray medium, preferably air and/or air-spray material mixture, which is fed to the flow bush (19) from the side (44) opposite its end wall (42) is ejected from the air distributor (18) through the two central flow holes (25, 26) as a jet (16). Further provided is a device (21) to shape the jet (16), which device (21) takes a part of the spray medium fed to the flow bush (19) in at least two rotational end positions between the flow bush (19) and air distributor (18) and directs this part onto the jet (16) obliquely to the latter's outlet direction (40) so that the jet is deformed, preferably flattened. The device (21) to shape the jet is ineffective in at least one of the rotational ranges between the rotational end positions between the flow bush (19) and air distributor (18) so that the jet (16) remains fundamentally unaffected. Bypass openings (27, 51) are provided for taking part of the spray medium fed to the flow bush (19) in the rotational range between the flow bush (19) and air distributor (18) and passes this part through the air distributor (18) to the outside such, that the jet (16) remains fundamentally unaffected (FIG. 4 ).

11 Claims, 6 Drawing Sheets

AIR NOZZLE WITH VARIABLE SPRAY PATTERN

FIELD OF THE INVENTION

The present invention relates to an air head or nozzle, in particular for a spray gun, with a flow bush and fitted air distributor which can be rotated at least in stages and whose end wall has a central flow hole which is opposed by a second central flow hole in an end wall of the flow bush facing the air distributor in such a way that the spray medium, preferably air and/or air-spray material mixture, which is fed to the flow bush from the side opposite its end wall is ejected from the air distributor through the two central flow holes as a jet, and a device to shape the jet which takes a part of the spray medium fed to the flow bush in at least two rotational end positions between the flow bush and air distributor and directs this onto the jet obliquely to its outlet direction so that this is deformed, preferably flattened, whereby the device to shape the jet is ineffective in at least one of the rotational ranges between the rotational end positions between the flow bush and air distributor so that the jet remains fundamentally unaffected.

Such an air head or crown is known from practice.

In the known air head the air distributor is designed as a bush and has an end wall with two lugs with deflection bores diametrically opposed to the flow hole. The flow bush is located inside the air distributor and this flow bush has four through holes arranged uniformly around the central flow hole in the end wall facing the air distributor.

The air distributor can be rotated by 90° against the flow bush whereby two of the through holes in the flow bush are aligned with the two deflection bores in the lugs of the air distributor in the two rotational end positions.

During operation two shaped jets flow out of the two lugs and these are directed obliquely onto the central jet, thus flattening this central jet. In one of the rotational end positions between the air distributor and flow bush the jet is a flat jet whereas in the other end position it lies transversely and is called a wide jet.

In one of the rotational ranges between the two rotational end positions the end wall of the air distributor covers the through holes in the end wall of the flow bush so that air can only escape through the central flow hole, thus forming a so-called circular jet which is fundamentally unaffected.

As for the adjustment and shape of the jet's cross-section, the air head described above is satisfactory. It is either connected directly to a compressor via a hose or forms part of a spray gun which is connected to the compressor by the hose.

In such spray devices and compressors the air which is taken in is not used solely to spray the spray material, it is also used to cool the compressor's motor.

Practice has now shown that in the rotational interim area, in other words when the through holes in the flow bush are covered by the end wall of the air distributor, the temperature of the compressor motor rises. However, such a rise in the motor temperature can be undesirable for a number of reasons, e.g. the compressor's service life can be reduced or this may lead to safety risks.

Taking these problems as a starting point the goal of this present invention is to solve the aforementioned heating problem through a simple constructive measure which has no detrimental effect on the operation of the air head.

SUMMARY OF THE INVENTION

According to the invention this object is achieved in the air head mentioned at the outset by providing a bypass means which withdraws or takes part of the spray medium fed to the flow bush in the rotational range between the flow bush and air distributor and passes this through the air distributor to the outside in such a way that the jet remains fundamentally unaffected.

The object on which the invention is based is solved completely by this surprisingly simple measure. The inventors of the present application have namely recognised that the heating problem at the compressor can be solved by simple modifications to the air head without affecting the quality of the jet. Contrary to expectations, it was possible to provide a bypass as described above in the air head so that part of the spray medium can escape through the air distributor to the outside without having a detrimental effect on the central jet. This reduces the motor heating by more than 10° C., which significantly prolongs the compressor's service life.

In this connection the inventors recognised that the device to shape the jet enables an additional passage of spray medium and thus air so that in the known air head more air with a correspondingly better cooling can be delivered from the compressor through the hose to the spray head in the two rotational end positions between the flow bush and air distributor at the same motor output than in the rotational interim range, where the device to shape the jet is ineffective. In the new air head the bypass device now ensures that sufficient air can be conveyed even in the rotational interim range.

In a preferred design variant of the invention the device to shape the jet displays at least one lug with a deflection bore hole in the end wall of the air distributor and at least one through or radial hole in the end wall of the flow bush which interacts with at least one lug for each of the rotational end positions so that spray medium can only pass through the through hole in the deflection bore hole and from here obliquely onto the jet in the rotational end positions.

This in itself familiar feature is a simple constructional measure to ensure that the spray head is designed to shape the jet.

In particular it is preferred if the device to shape the jet displays two lugs diametrically opposed to the first central flow hole as well as a pair of through holes diametrically opposed to the second central flow hole for each of the rotational end positions.

This measure too is in itself known and has the advantage that the jet can be shaped symmetrically by simple means.

It is then preferred if the bypass device displays at least a through hole in the end wall of the flow bush and an opening in the end wall of the air distributor radial to this which is aligned circumferentially in such a way that the through hole and the opening are only axially aligned with one another in the rotational range between the flow bush and air distributor.

This measure has the advantage that the bypass device is an extremely simple construction. The inventors have namely recognised that it is possible to provide additional through holes and openings in the flow bush and air distributor alongside the central flow holes which are aligned when the flow bushes and air distributor are not in the rotational end positions with no impairment of the jet's quality. In other words, in addition to the central, circular jet a further, smaller jet is emitted lateral to this central jet which is dimensioned in such a way that with the same motor output for the compressor essentially the same volume of air can be conveyed as is conveyed in the end positions. This also means that the new air head is designed in such a way that the flow resistance in the rotational end positions is essentially identical to that in the rotational interim range.

It is particularly preferred if the through holes in the bypass device are the through holes of the device to shape the jet.

This measure has the advantage that in the new air head no changes have to be made to the flow bush, the only changes that are needed are to the air distributor so that very little constructive work is needed to produce the new air head.

It is then preferred if two openings are provided diametrically opposed to the first central flow hole.

The advantage here is that the bypass air is split between two openings so that the flow resistance can be more easily adjusted than when only one opening is provided.

In one design variant it is then preferred if two pairs of through holes are provided and these four through holes are arranged at almost equal distances around the circumference so that there are two rotational end positions offset by approx. 90° to one another.

The advantage of this in itself known measure is that a flat jet can be altered into a transverse jet vertical to this and vice versa through a simple twist of the air distributor compared to the flow bush.

On the whole it is preferred when a limit stop is provided which is effective in the two rotational end positions.

This in itself familiar measure also leads to a constructionally simple air head which can now be easily operated. In order to change from a flat jet to a transverse jet and vice versa the air distributor only has to be rotated so that it rests against the limit stop in one of its rotational end positions.

In one design variant it is then preferred if the opening is preferably a curving longitudinal slot whose clear opening roughly corresponds with the diameter of the corresponding through hole.

In this measure it is once again the simple construction which is advantageous, an opening only has to be milled into the end wall of the air distributor which does not affect the escape of air through the through holes of the flow bush in the rotational interim range since its clear space approximately corresponds to the diameter of the corresponding through hole.

It is hereby advantageous when the circumferential direction of the opening covers an area which corresponds to the circumferential distance between the external edges of two adjacent through holes.

This measure enables a particularly easy operation of the new air head. This opening namely exposes the corresponding through hole in the end wall of the flow hole in the rotational interim range between the two rotational end positions so that no particular care has to be taken when rotating the air distributor.

Further advantages result from the description and the enclosed drawing.

BRIEF DESCRIPTION OF THE DRAWINGS

It is understood that the features described above and in the following can be used not only in the respectively quoted combinations but also in other combinations or alone without going beyond the scope of the present invention.

A design variant of the invention is shown in the drawings and will be explained in more detail in the following description. These show.

DESCRIPTION OF THE PREFERRED EMBODIMENT

Figure 1:
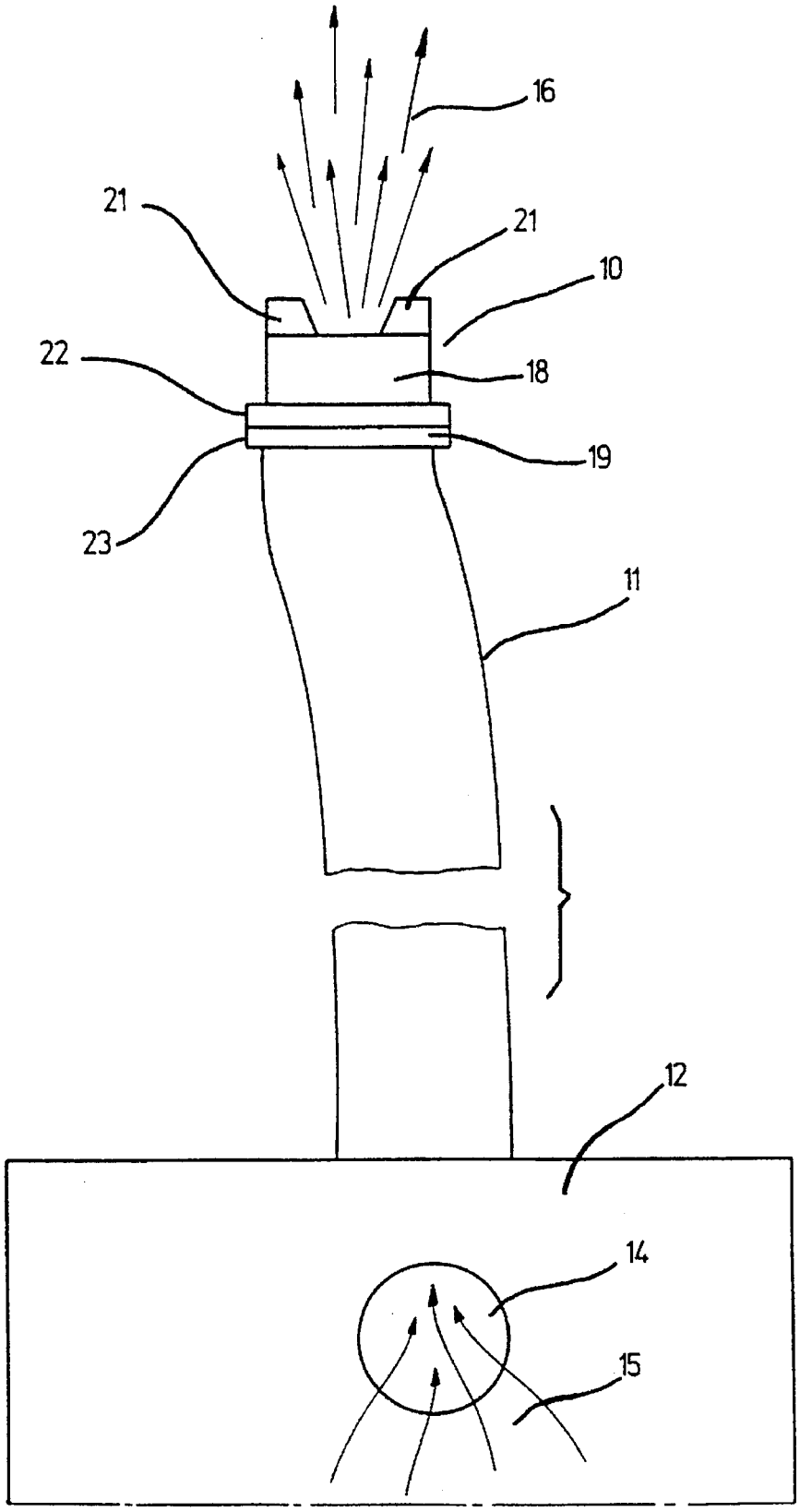
FIG. 1 a diagrammatic arrangement of the new air head on a compressor hose.

In FIG. 1, 10 indicates an air head connected to a compressor 12 via a hose 11. The compressor 12 sucks in air 15 through an opening 14, mixes this as required with spray material and conveys the resulting spray medium as a jet 16 forwards out of the air head 10. In addition, the air which is taken in 15 is used to cool a motor in the compressor 12.

The air head 10 displays an air distributor 18 and a flow bush 19 which is inserted in this air distributor. In FIG. 1 it can also be seen that the air distributor 18 has two lugs 21 on its front side and a collar 22 on its rear side which rests on a collar 23 of the flow bush 19.

Figure 2:
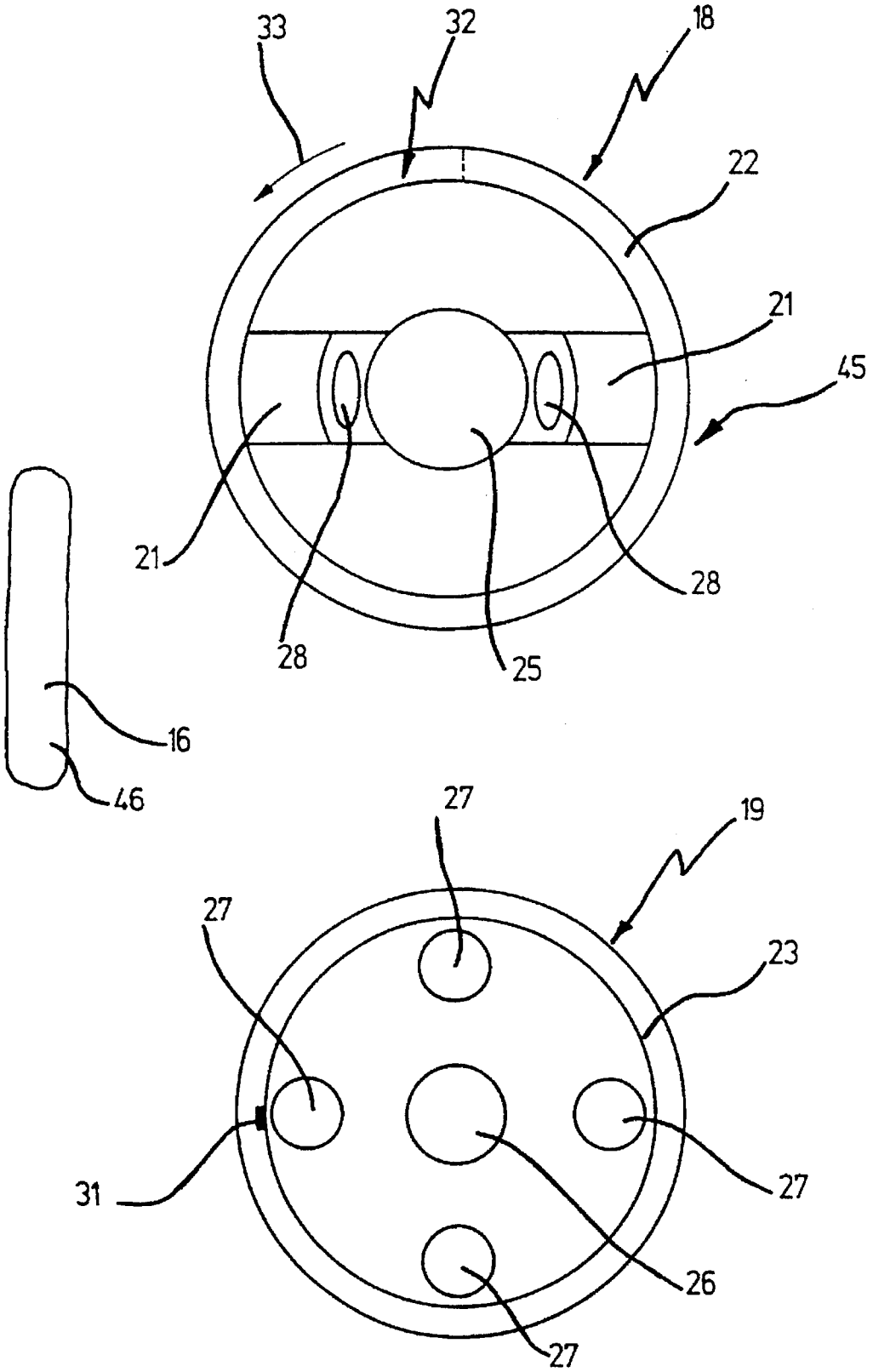
FIG. 2 a top view of the air distributor and the flow bush of a known air head in its first rotational end position.
Figure 3:
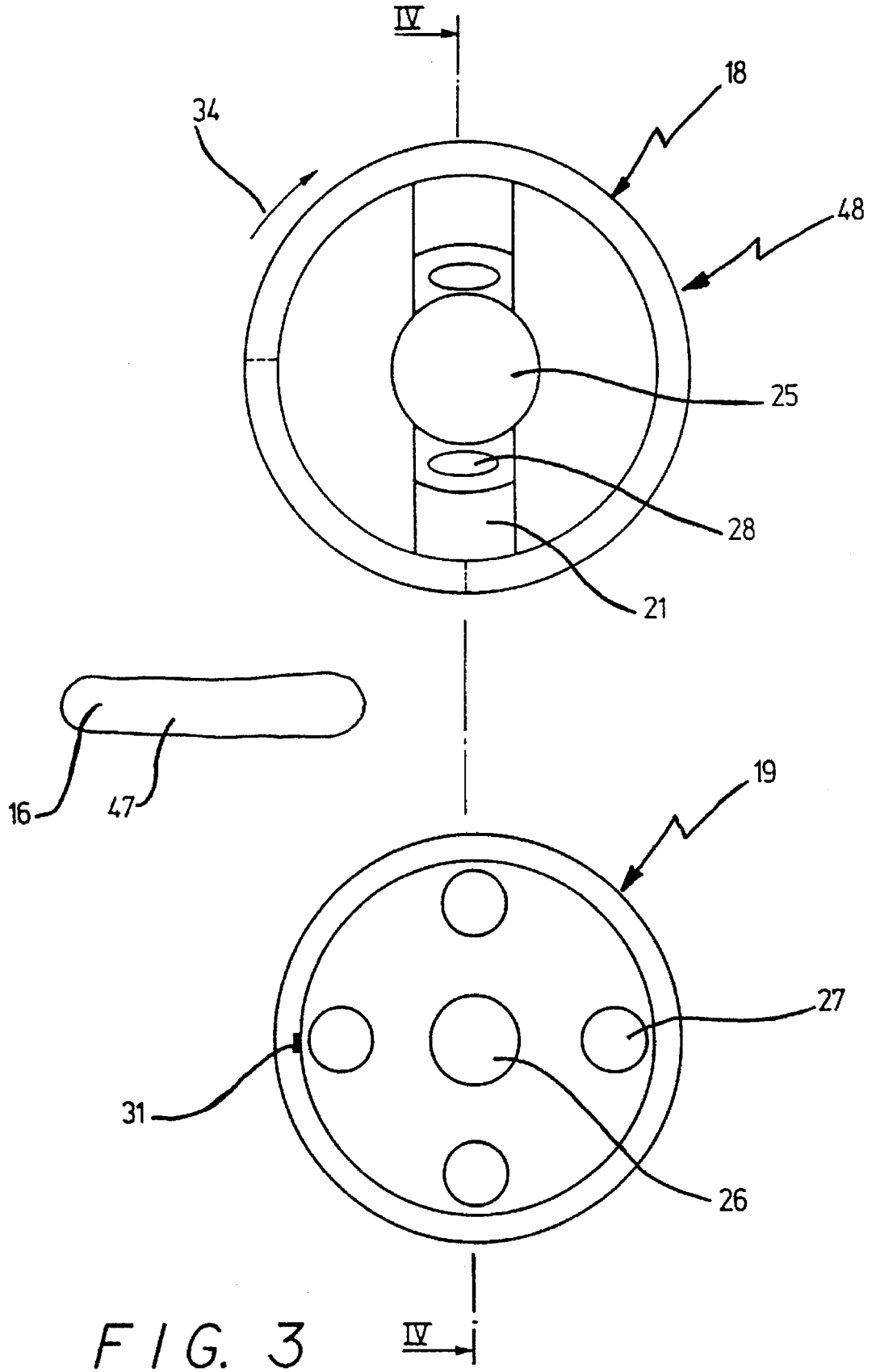
FIG. 3 a view of FIG. 2, though in the second rotational end position.

In FIGS. 2 and 3 the air distributor 18 and flow bush 19 are shown in their correct positions below one another so as to explain their interaction. In this connection reference is also made to FIG. 4 in which the air distributor 18 and the flow bush 19 are shown in longitudinal section one after the other.

It can be seen that the air distributor 18 has a central flow hole 25 with a corresponding second central flow hole 26 in the flow bush 19 which is positioned in such a way that these two flow holes lie centrally on top of one another in the centre of the air head so that the flow holes are aligned. There are four through holes 27 arranged around the central flow hole 26 in the flow bush 19 which are spaced equally around the circumference. These through holes 27 act together with deflection bore holes 28 which are provided in the lugs 21 of the air distributor 18.

FIG. 2 also shows a limit stop 31 which is provided on the collar 23 of the flow bush 19. This limit stop 31 interacts with a notch in the collar 22 of the air distributor, shown in FIG. 2 as a dotted line, in such a way that the air distributor 18 can be rotated around 90° against the flow bush 19 in the direction of rotation 33 and back again in the direction of rotation 34.

Figure 4:
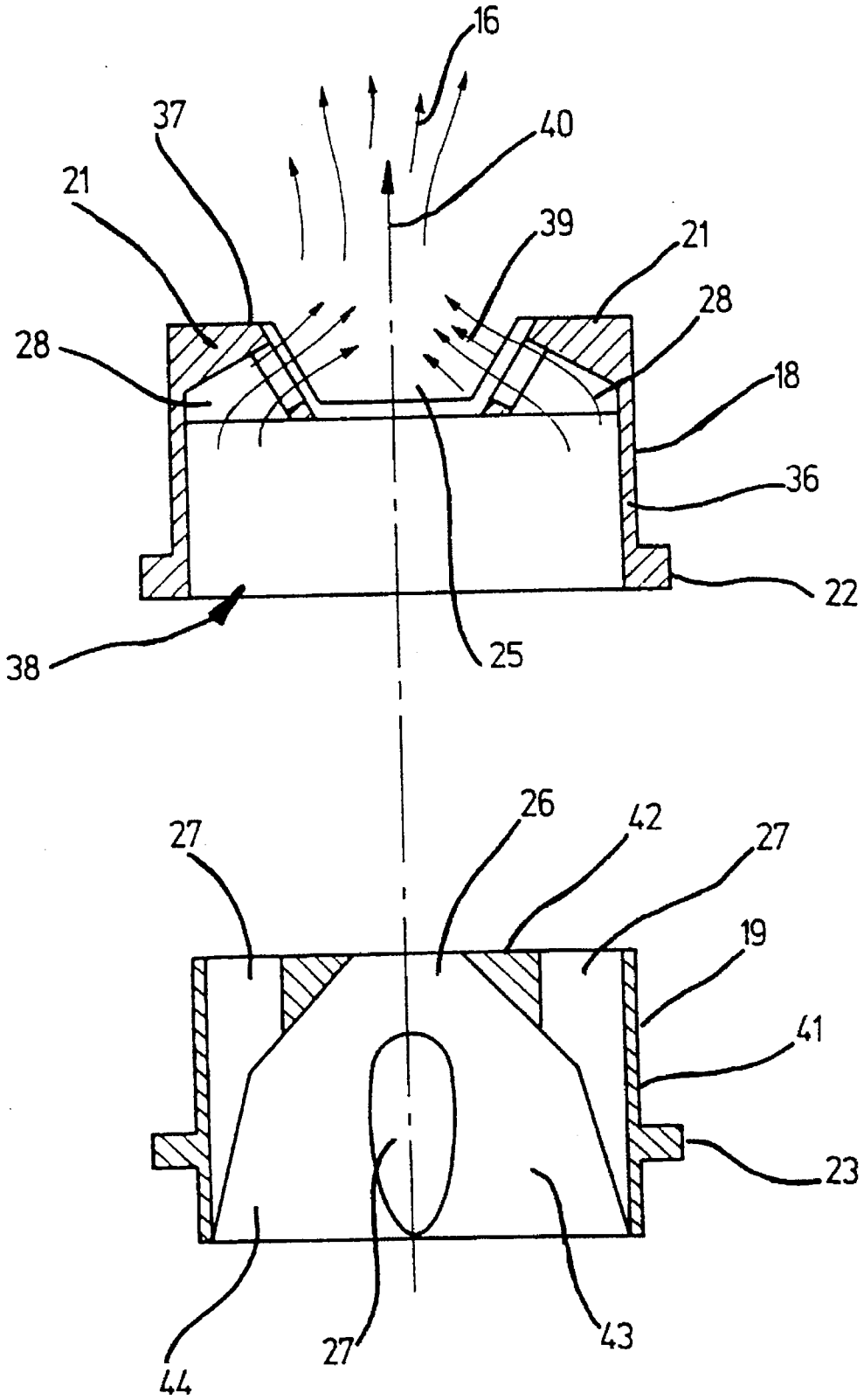
FIG. 4 a longitudinal section along the line IV—IV in FIG. 3 through the air distributor and flow bush.

From FIG. 4 it can be seen that the air distributor 18 encircles a bush 36 with an end wall 37, opposite to which there is a hole 38 to insert the flow bush 19. In the cross-section diagram in FIG. 4 it can also be seen that the deflection bore holes 28 create two shaped jets 39 which run obliquely to the outlet opening 40 of the jet 16 and which press this together.

The flow bush 19 encircles a cylindrical wall 41 with an end wall 42 displaying a conically-shaped interior 43 which is designed in such a way that air which is fed in from the feed side 22 is collected and guided in the direction of the central flow hole 26.

In FIG. 4 it can also be seen that the through holes 27 are partially tapered and rest in the cylindrical wall 41 of the flow bush 19.

During operation of the known air head 10 described above the majority of the spray mixture flows through the flow hole 26 and the correspondingly larger flow hole 25 to the outside. The through holes 27 and the deflection bore holes 28 in the lugs 21 act as a device to shape the jet, they create the shaped jets 39 which compress and flatten the jet 16. Depending on the rotational end position between the air head 18 and flow bush 19, a flat jet 46 is produced in the rotational end position 45 shown in FIG. 2 whereas a wide jet 47 is produced in FIG. 3 by the rotational end position 48 which is offset by approx. 90°.

Figure 5:
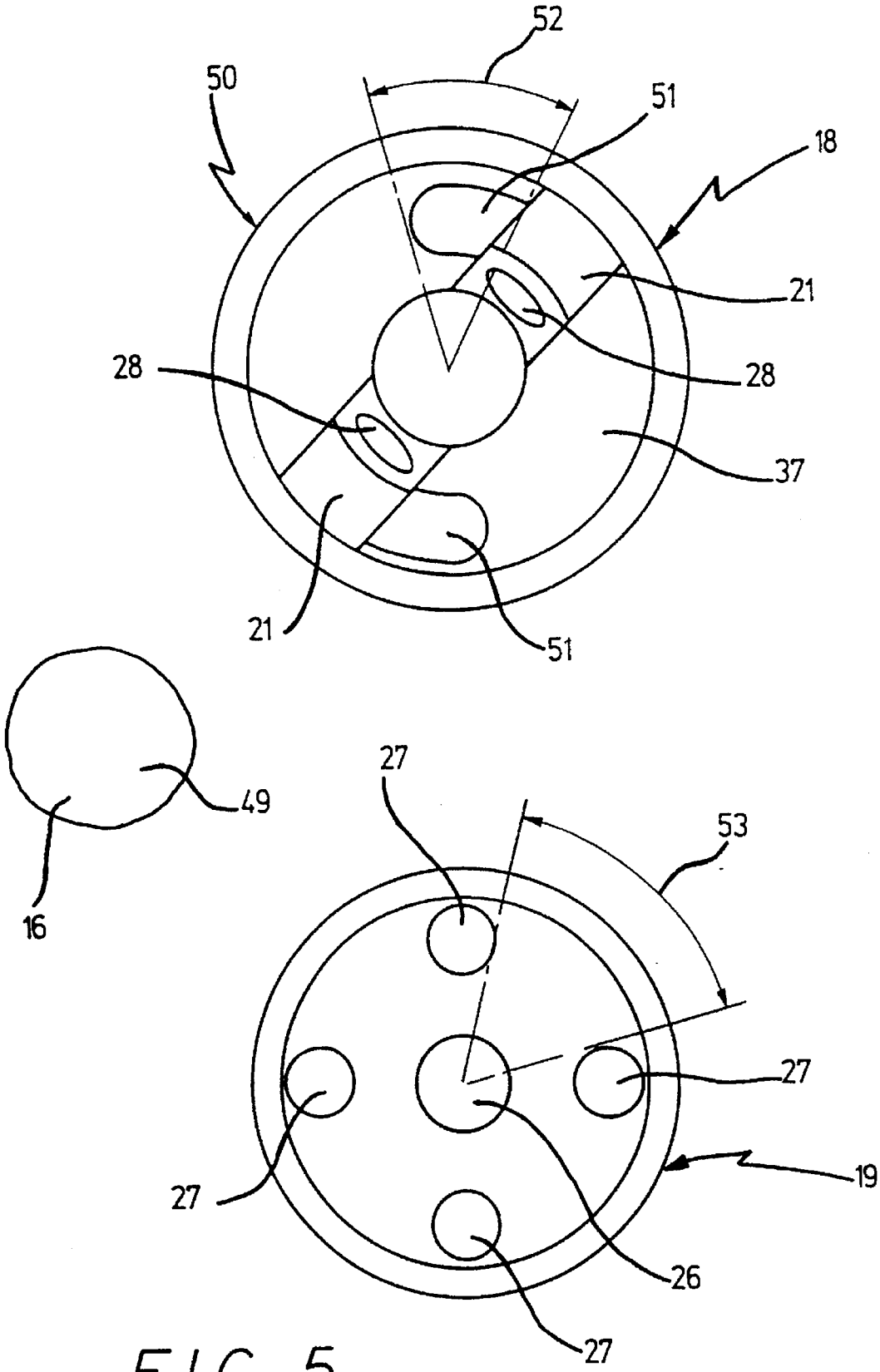
FIG. 5 a top view as in FIGS. 2 and 3, though of the new air head and in a rotational interim position.

FIG. 5 shows the production of a circular jet 49 whereby the air distributor 18 is rotated against the flow bush 19 in such a way that it is located in a rotational interim range 50 between the two rotational end positions 45, 48. In this rotational interim range the end wall 37 of the air distributor 18 covers the through holes 27.

In order to now provide a bypass device in accordance with the invention, circumferentially extending openings 51 are provided in the end wall 37, each of which are assigned to a pair of through holes 27. In the rotational end positions 45, 48 as shown in FIGS. 2 and 3—where the openings 51 are not shown for reasons of clarity—these openings 51 are covered from below by the end wall 42 of the flow bush 19. In the rotational interim range 50 according to FIG. 5 these openings 51 are now positioned over the through holes 27 so that in addition to the circular jet 49, two additional jets which are not shown here can escape from the new air head 10. This bypass ensures that the flow resistance offered by the new air head to the conveyed spray medium does not differ greatly in the rotational interim range from that in the rotational end positions 45, 48.

For this purpose the openings 51 have a clear opening in a radial direction which roughly corresponds to the diameter of the through holes 27. Moreover, the openings 51 have a circumferential length which is slightly shorter than the circumferential distance between two outer edges of two adjacent through holes 27. The corresponding angles are shown as 52 and 53 in FIG. 5. Angle 52 hereby corresponds with the rotational range in which the air distributor 18 can be rotated against the flow bush 19 without leaving the rotational interim range.

Thus, whereas the limit stop 31 ensures an exact positioning between air distributor 18 and flow bush 19 in the two rotational end positions 45, 48, such a precise positioning in the rotational interim range 52 is not necessary on account of the circumferential length of the openings 51.

Figure 6:
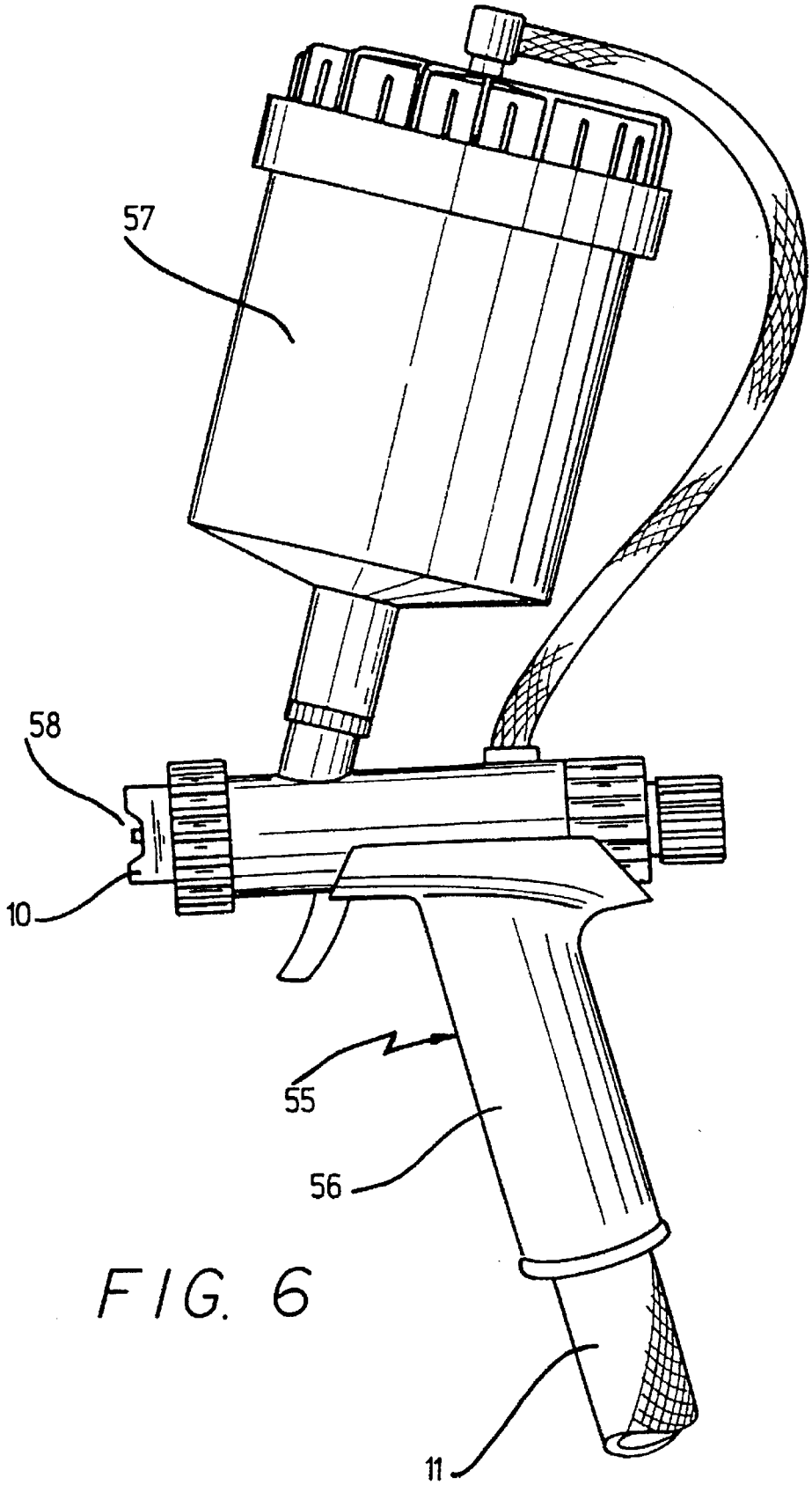
FIG. 6 the new air head in use with a spray gun connected to the compressor.

Finally, FIG. 6 shows that the new air head 10 can also be used in conjunction with a spray gun 55 which in itself has a familiar handle 56 and spray material reservoir 57 and which is connected to the compressor 12 via a hose 11. In the design variant shown in FIG. 6 the spray material and the air are mixed in the spray gun 55 whereas in the design variant as shown in FIG. 1 the mixing takes place in the compressor 12 itself.

Alternatively, the spray gun 55 can also display a fine nozzle 58 located centrally in the flow holes which releases spray material directly to the outside where it mixes with the air emitted by the air head 10. This air serves as a flow of carrier air for the spray medium. Surprisingly it has now been shown that by increasing the volume of air during circular jet operation with the new air head 10, the carrier air flow is improved which in turn further improves the application of e.g. paint.

I claim:

1. An air nozzle, for ejecting a central jet of spray medium along an outlet axis, in particular for a spray gun, comprising:

a flow bush including an end wall with a first central flow hole aligned with said outlet axis, and an inlet opening opposing said end wall;

an air distributor rotationally fitted onto said flow bush for rotation with respect to said flow bush at least through one rotational range between two rotational end positions, said air distributor including adjacent to said end wall of said flow bush a further end wall having a second central flow hole aligned with said outlet axis;

whereby spray medium fed to the flow bush via the inlet opening is ejected from the air nozzle through said two central flow holes, thereby forming said central jet along said outlet axis;

means for shaping said central jet, said shaping means arranged for directing a part of said spray medium onto said central jet in a first direction substantially intersecting said outlet axis when said air distributor is in one of said two rotational end positions relative to said flow bush; and bypass means arranged for ejecting said part of said spray medium from said air nozzle as an additional jet to said central jet, in a second direction substantially nonintersecting with said outlet axis when said air distributor is in said rotational range between said two rotational end positions, said additional jet being substantially separate from said central jet.

2. The air nozzle of claim 1, wherein the shaping means comprise at least one lug with a deflection bore hole in the end wall of the air distributor and at least one radial hole in the end wall of the flow bush which interacts with the at least one lug such that said part of said spray medium can substantially only pass through the radial hole into the deflection bore hole and therefrom obliquely onto the central jet when said air distributor is in one of said rotational end positions.

3. The air nozzle of claim 4, wherein the shaping means comprise two lugs arranged at said air distributor diametrically to the first central flow hole, and two radial holes arranged in said end wall of said flow bush diametrically to the second central flow hole.

4. The air nozzle of claim 1, wherein the bypass means comprise at least one radial hole in the end wall of the flow bush and a circumferentially extending opening in the end wall of the air distributor, said circumferentially extending opening and said radial hole positioned in alignment with one another only when the air distributor is in the rotational range between said rotational end positions.

5. The air nozzle of claim 2, wherein the bypass means comprise a circumferentially extending opening in the end wall of the air distributor, said circumferentially extending opening and said radial hole positioned in alignment with one another substantially only when the air distributor is in the rotational range between said rotational end positions.

6. The air nozzle of claim 5, wherein two circumferentially extending openings are provided in said end wall of said air distributor diametrically opposed to the first central flow hole.

7. The air nozzle of claim 3, wherein the bypass means comprise at least one radial hole in the end wall of the flow bush and a circumferentially extending opening in the end wall of the air distributor, said circumferentially extending opening and said radial hole positioned in alignment with one another substantially only when the air distributor is in the rotational range between said rotational end positions.

8. The air nozzle of claim 7, wherein two pairs of each two radial holes are provided, the four radial through holes being arranged at almost equal distances around the circumference of said first central flow hole, and wherein two rotational end positions are provided offset to one another by approximately 90°.

9. The air nozzle of claim 8, wherein a limit stop is provided between the flow bush and the air distributor, which limit stop is effective in the two rotational end positions.

10. The air nozzle of claim 8, wherein the circumferentially extending opening in the end wall of the air distributor is a bent longitudinal slot having a clear opening corresponding to the diameter of the corresponding radial hole in the end wall of the flow bush.

11. The air nozzle of claim 10, wherein the circumferential length of the circumferentially extending opening in the end wall of the air distributor corresponds to the circumferential distance between opposing edges of two adjacent radial holes in the end wall of the flow bush.

* * * * *

UNITED STATES PATENT AND TRADEMARK OFFICE

CERTIFICATE OF CORRECTION

PATENT NO. : 5,645,220

DATED : July 8, 1997

INVENTOR(S) :. Wolfgang Hohndorf

It is certified that error appears in the above-identified patent and that said Letters Patent is hereby corrected as shown below:

Column 6, line 30, "the at least" should be –at least--.

Column 6, line 36, "claim 4" should be –claim 2--.

Column 6, line 42, "wail" should be –wall--.

Column 6, line 46, "one another only" should be –one another substantially--.

Signed and Sealed this

Thirtieth Day of June, 1998

*Attest:*

*Attesting Officer*

Bruce Lehman

BRUCE LEHMAN

*Commissioner of Patents and Trademarks*